US007140159B2

(12) United States Patent
Avendano et al.

(10) Patent No.: US 7,140,159 B2
(45) Date of Patent: Nov. 28, 2006

(54) PUSH-IN REFRIGERATOR DOOR SEAL AND RETAINER SYSTEM

(75) Inventors: Jose G. Avendano, Coal Valley, IL (US); Larry Corbin, Cameron, IL (US); John P. Myers, Galesburg, IL (US)

(73) Assignee: Maytag Corporation, Newton, IA (US)

( * ) Notice: Subject to any disclaimer, the term of this patent is extended or adjusted under 35 U.S.C. 154(b) by 842 days.

(21) Appl. No.: 10/385,605

(22) Filed: Mar. 12, 2003

(65) Prior Publication Data

US 2004/0177591 A1 Sep. 16, 2004

(51) Int. Cl.
*E04C 2/54* (2006.01)

(52) U.S. Cl. ..... 52/784.1; 312/401

(58) Field of Classification Search ..... 52/784.13, 52/784.15, 792.1, 794.1; 49/475.1, 501; 312/401, 405, 405.1, 406, 296
See application file for complete search history.

(56) References Cited

U.S. PATENT DOCUMENTS

| | | | | | |
|---|---|---|---|---|---|
| 2,591,003 | A | | 4/1952 | Philipp | 20/35 |
| 3,226,367 | A | | 12/1965 | Monti | 20/69 |
| 3,242,537 | A | * | 3/1966 | Angelo | 49/402 |
| 3,331,648 | A | * | 7/1967 | Petkwitz et al. | 312/296 |
| 3,378,957 | A | | 4/1968 | Frehse | 49/487 |
| 3,732,646 | A | | 5/1973 | Horvay et al. | 49/487 |
| 3,768,206 | A | * | 10/1973 | Lingle | 49/490.1 |
| 3,822,462 | A | * | 7/1974 | Chubb | 29/416 |
| 3,882,637 | A | | 5/1975 | Lindenschmidt | 49/501 |
| 4,305,230 | A | | 12/1981 | Gerritsen | 49/487 |
| 4,370,831 | A | * | 2/1983 | Hamilton | 49/477.1 |
| 4,469,383 | A | * | 9/1984 | Losert | 312/296 |
| 4,496,201 | A | | 1/1985 | Allgeyer | 312/296 |
| 4,583,796 | A | | 4/1986 | Nakajima et al. | 312/214 |
| 4,617,759 | A | | 10/1986 | Pasqualini et al. | 49/487 |
| 4,653,819 | A | | 3/1987 | Swerbinsky | 312/296 |
| 4,700,509 | A | | 10/1987 | Merla | 49/487 |
| 4,829,652 | A | * | 5/1989 | Haas et al. | 29/451 |
| 4,916,864 | A | | 4/1990 | Thompson | 49/478 |
| 5,007,226 | A | * | 4/1991 | Nelson | 52/784.15 |
| 5,060,358 | A | * | 10/1991 | Haas et al. | 29/235 |
| 5,193,310 | A | | 3/1993 | Kiel | 49/501 |
| 5,289,657 | A | | 3/1994 | Kiel | 49/478.1 |
| 5,297,360 | A | | 3/1994 | Besore et al. | 49/484.1 |
| 5,374,118 | A | * | 12/1994 | Kruck et al. | 312/407 |
| 5,487,239 | A | | 1/1996 | Jenkins et al. | 49/498.1 |
| 5,533,311 | A | | 7/1996 | Tirrell et al. | 52/309.9 |
| 5,551,192 | A | | 9/1996 | Avendano et al. | 49/484.1 |
| 5,588,731 | A | | 12/1996 | Schmidt et al. | 312/405 |
| 5,606,828 | A | | 3/1997 | Hall et al. | 49/490.1 |

(Continued)

*Primary Examiner*—Leslie A. Braun
*Assistant Examiner*—A. Joseph Wujciak
(74) *Attorney, Agent, or Firm*—Diederiks & Whitelaw, PLC

(57) ABSTRACT

An in-turned annular flange of a refrigerator door panel is interconnected to an out-turned flange of a door liner through the use of individual seal and liner retainer elements which enable the liner to be snap connected to the door panel. More specifically, with one of the retainer elements initially attached to the door panel and the remaining elements are attached to respective side portion of the liner. One side of the liner is initially attached to the door panel and then the liner is pivoted until the remaining sides of the liner are snap-connected to the door panel. After the door panel, liner and retainer assembly are foamed during an insulation procedure, all the components are securely held in place. Finally, a door seal, which includes primary and secondary seal elements, is interengaged with first and second seal connecting structure defined by the retainer elements.

24 Claims, 5 Drawing Sheets

U.S. PATENT DOCUMENTS 5,704,107 A 1/1998 Schmidt et al. ..... 29/460
5,727,349 A * 3/1998 McLaughlin ..... 49/501
5,789,724 A * 8/1998 Lerssen et al. ..... 219/741
5,816,080 A 10/1998 Jeziorowski ..... 62/441
5,881,710 A * 3/1999 Davis et al. ..... 126/194
5,909,937 A * 6/1999 Jenkins et al. ..... 312/405.1
5,934,098 A * 8/1999 Lee ..... 62/440
5,941,624 A * 8/1999 Pfeffer et al. ..... 312/405.1
6,055,823 A * 5/2000 Baker et al. ..... 62/265
6,138,432 A * 10/2000 Banicevic ..... 52/784.15
6,158,171 A * 12/2000 Kellogg et al. ..... 49/489.1
6,722,083 B1 * 4/2004 Herrmann et al. ..... 49/501

* cited by examiner

PUSH-IN REFRIGERATOR DOOR SEAL AND RETAINER SYSTEM

BACKGROUND OF THE INVENTION

1. Field of the Invention

The present invention pertains to the art of refrigerators and, more particularly, to the structure and mounting of a seal assembly between a pivotable door and a refrigerator cabinet.

2. Discussion of the Prior Art

It is widely known in the art to provide a seal assembly between a pivotable door and a cabinet portion of a refrigerator in order to aid in maintaining desired environmental conditions within the cabinet when the door is closed. When deciding on employing a particular seal assembly in connection with a refrigerator, not only is it necessary to consider the sealing capabilities of the assembly which will have a direct bearing on the energy efficiency of the refrigerator, but the cost effectiveness, ease of assembly and overall aesthetics are important.

These various factors are affected by many parameters, including the design of the seal itself and the manner in which the seal is retained by the door. Regardless of the fact that there exists an abundance of prior proposed refrigerator door seal assemblies, there still exists a need for an improved seal assembly which is simple in construction, exhibits extremely effective sealing characteristics and is designed, in combination with door connecting structure, to be easily assembled.

SUMMARY OF THE INVENTION

The present invention is directed to a door seal and retainer arrangement for a refrigerator. More specifically, an in-turned annular flange of a refrigerator door panel is interconnected to an out-turned peripheral flange of a door liner through the use of four individual seal and liner retainer elements. Each of these retainer elements is preferably extruded, with three of the four retainer elements defining first and second slots or channels which open in opposite directions and which extend in substantially parallel, offset planes. The slots are generally defined by a common base and respective captive flanges which are attached to and extend substantially parallel to the base on opposite sides thereof.

During assembly, three out of the four retainer elements are identically constructed and assembled to respective out-turned flanges of the door liner with each of the door liner flanges being received within a respective slot. The remaining retainer element is attached to an in-turned flange on one side of the door panel. In attaching the door liner to the door panel, the exposed out-turned flange of the door liner is initially inserted in a channel defined by the retainer element attached to the door panel. Thereafter, the door liner is pivoted toward the door panel, whereupon structure on the liner carried retainer elements become snap-connected to respective in-turned flanges of the door panel. After the door panel, liner and retainer assembly are foamed during an insulation procedure, all the components are securely held in place.

Once the door panel and liner are integrated through the use of the various retainer elements and the foamed insulation, a door seal is then secured to the various retainer elements. In accordance with the preferred embodiment, each of the retainer elements is formed with an elongated cavity having an opening exposed opposite the liner, as well as a lip defining member which projects away from the front of the door panel. The door seal includes inner and outer seal elements and is integrally formed with an elongated dart member which is inserted into the cavity, as well as a hook element which engages the lip member. When connected at the lip, the door seal is actually stretched and snapped into place.

Additional objects, features and advantages of the invention will become more fully apparent from the following detailed description of a preferred embodiment thereof when taken in conjunction with the drawings wherein like reference numerals refer to corresponding parts in the several views.

DETAILED DESCRIPTION OF A PREFERRED EMBODIMENT

Figure 1:
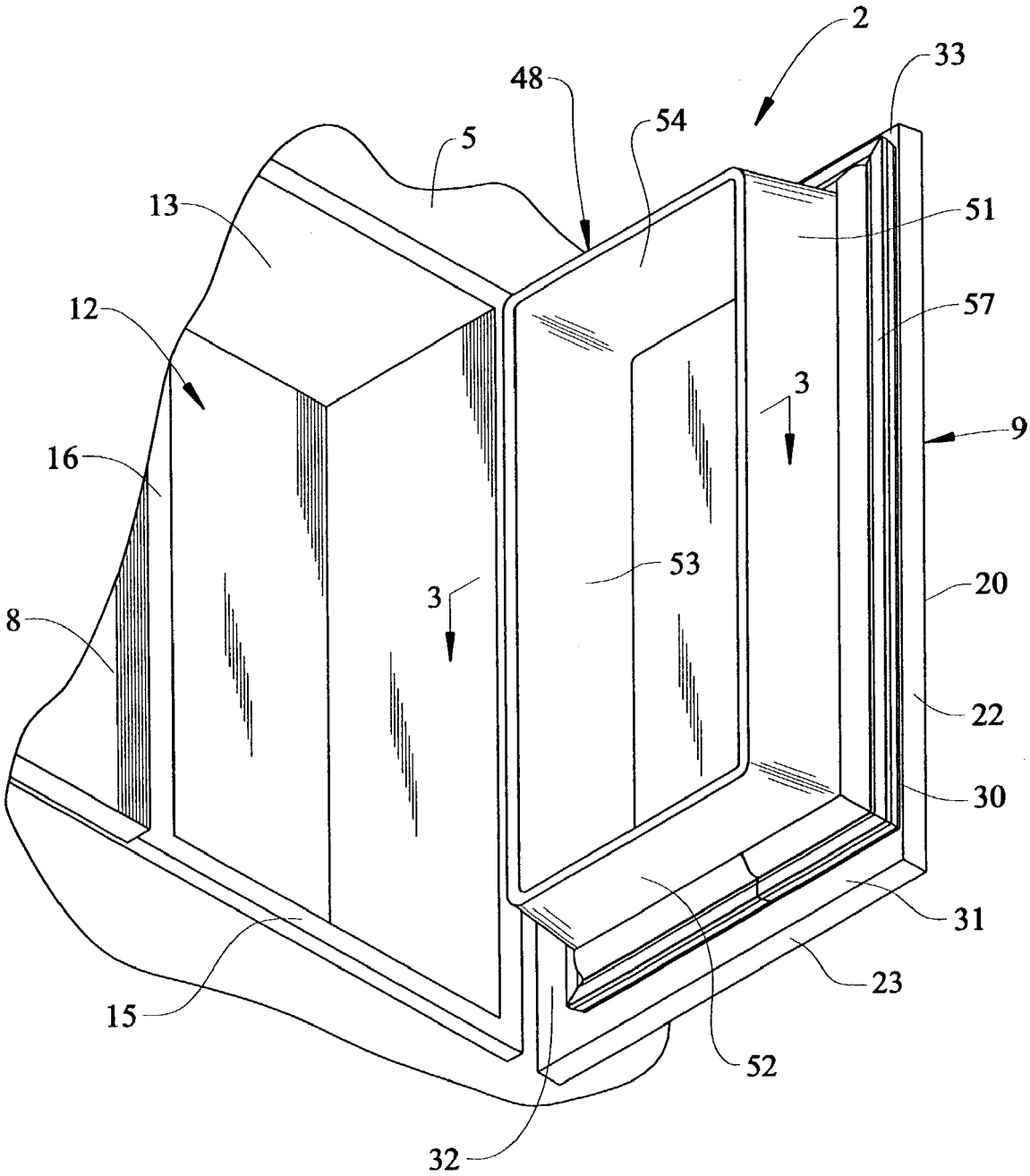
FIG. 1 is a partial perspective view of a refrigerator cabinet with a door, which incorporates the seal and retainer system of the invention, in an open condition.

With initial reference to FIG. 1, a partial view of a side-by-side refrigerator 2 is shown. As illustrated, refrigerator 2 is recessed within a wall 5 such as in a household kitchen. Refrigerator 2 is shown to include a freezer door 8 and a fresh food door 9. Fresh food door 9 is shown in an open condition such that a fresh food compartment 12, preferably defined by liner 13, is exposed. Liner 13 can be formed of various materials, including plastic. However, in accordance with the most preferred embodiment of the invention, liner 13 is formed from pre-painted steel. Also exposed from wall 5 is a front peripheral face 15 of refrigerator 2, as well as a vertical mullion face 16. In the most preferred embodiment of the invention, faces 15 and 16 are also formed of metal.

Obviously, refrigerator 2 is shown quite generically, basically because the current invention is particularly directed to the construction of one or more of doors 8 and 9 as will now be discussed in detail. With respect to the invention, either or both doors 8 and 9 can be constructed in the manner set forth below such that only the preferred construction of fresh food door 9 will now be detailed. Door 9 includes an outer door panel 20 which is shown to be substantially planar but which could include one or more arcuate or bulging portions for aesthetic or other reasons. In any event, outer door panel 20 leads to side wall portions 22–25 of door 9 and, in turn, side wall portions 22–25 lead to in-turned flanges 30–33 respectively. In the most preferred form of the invention, outer door panel 20, side wall portions 22–25 and in-turned flanges 30–33 are formed by bending a single sheet of metal. However, composite materials could also be utilized to form this structure.

Fresh food door 9 also includes a plurality of retainer elements 37–40 in the form of strips used to connect an out-turned peripheral flange 46 of a liner 48 to in-turned flanges 30–33 as will be detailed more fully below. As shown, liner 48 preferably includes various dike portions 51–54. Finally, fresh food door 9 also includes a seal assembly generally indicated at 57.

Figure 3:
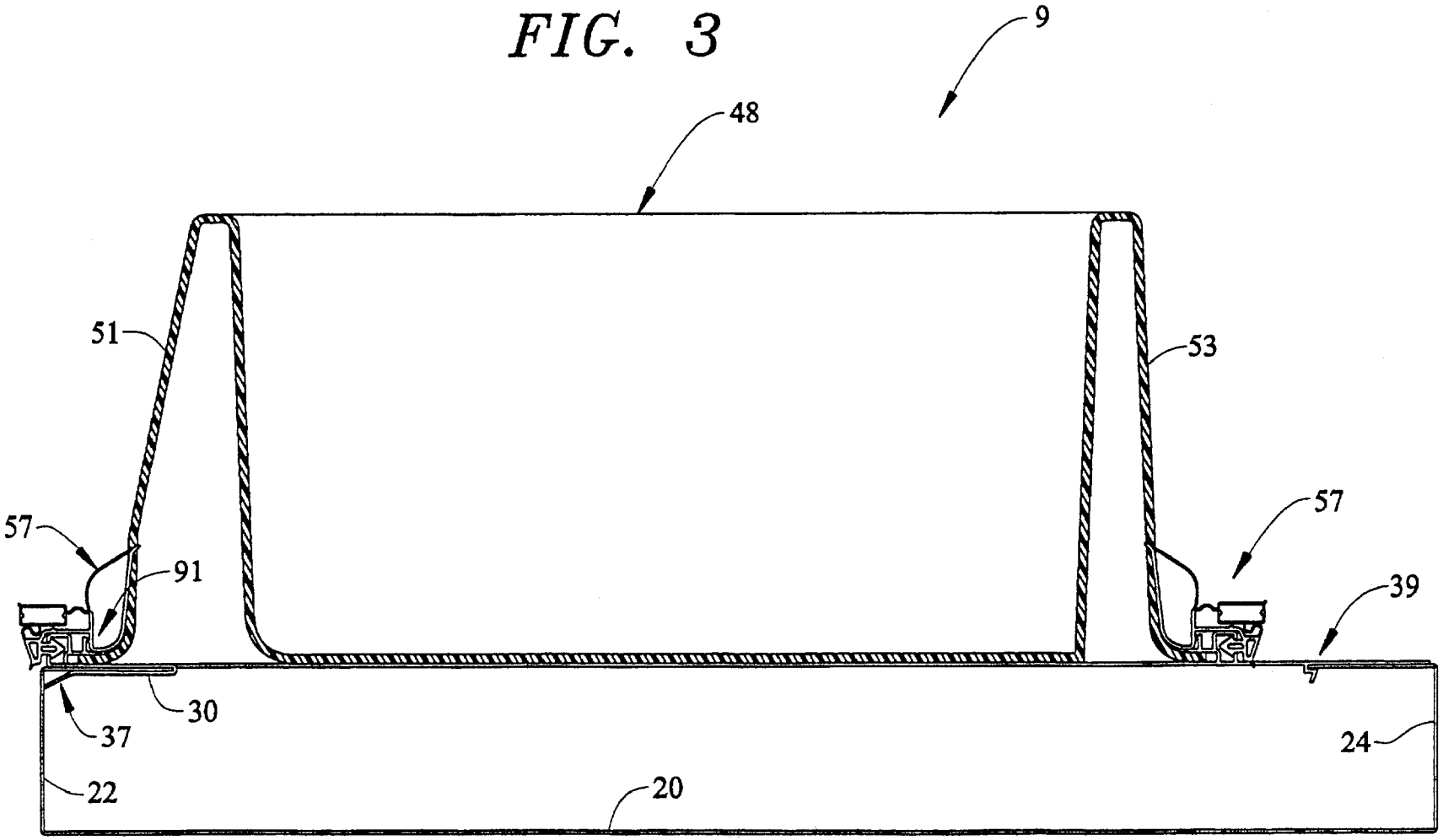
FIG. 3 is a partial cross-sectional view taken along line 3—3 of FIG. 1.
Figure 4:
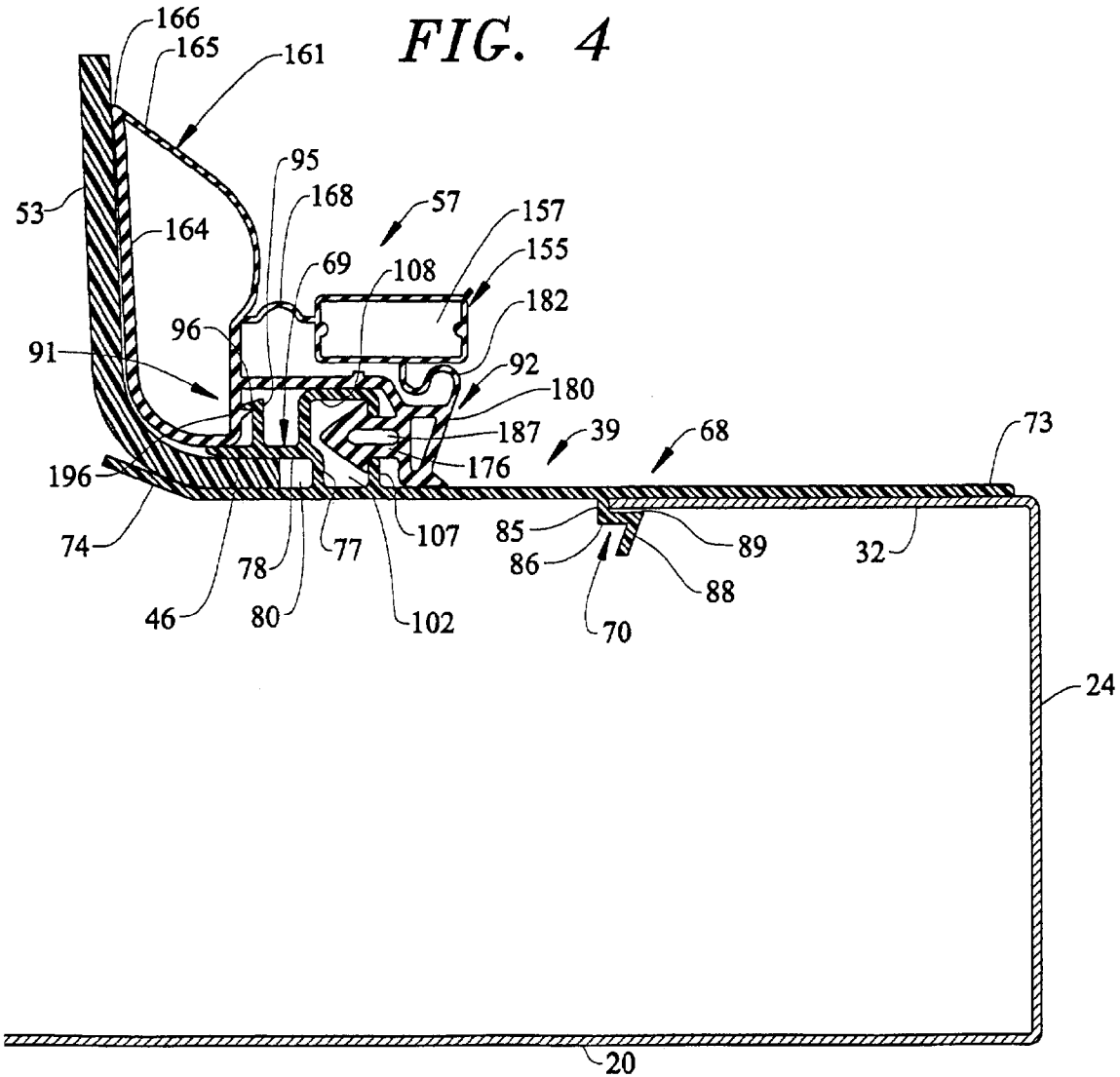
FIG. 4 is an enlarged view of a section of the refrigerator door of FIG. 3.
Figure 5:
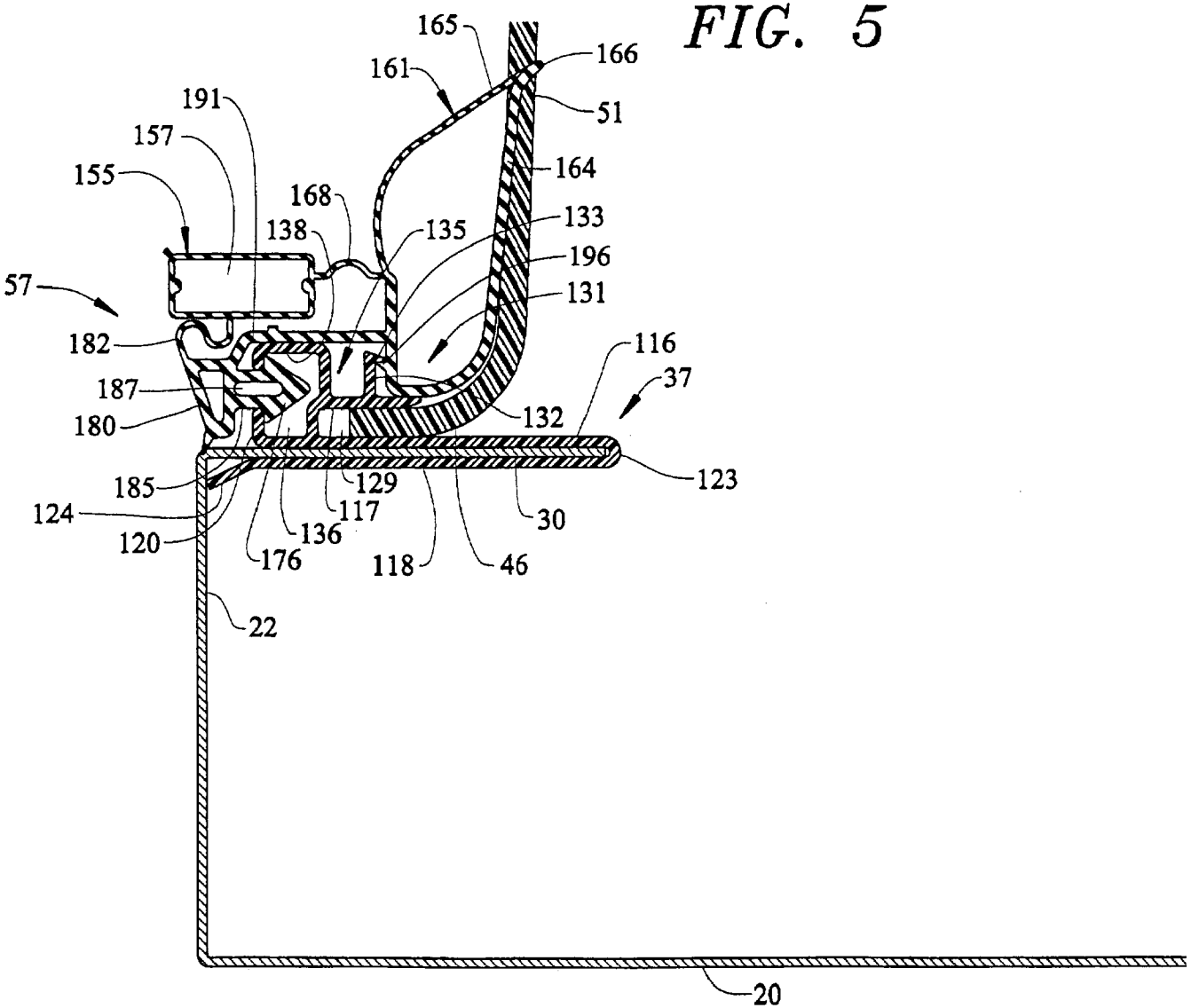
FIG. 5 is an enlarged view of another section of the refrigerator door of FIG. 3.

With particular reference to FIGS. 3–5, the preferred construction of retainer elements 37–40 will now be described in detail. Except for variations in length, retainer elements 38–40 are preferably, identically constructed such that the preferred embodiment of retainer element 39 will initially be described in detail and it is to be understood that corresponding structure is utilized for retainer elements 38 and 40. As shown in at least FIGS. 3 and 4, retainer element 39 is preferably integrally molded of plastic and includes first, second and third leg portions 68–70. As perhaps best shown in FIG. 4, first leg portion 68 includes an outer terminal end 73 and an inner, angled end 74. From adjacent angled end 74 projects second leg portion 69. More specifically, second leg portion 69 is defined by a leg section 77 which projects from first leg portion 68, as well as an in-turned leg section 78. In the most preferred form of the invention shown, in-turned leg section 78 also extends substantially parallel to a majority of first leg portion 68. With this construction, a first retaining slot 80 is defined between first and second leg portions 68 and 69, with first retaining slot 80 opening in a direction opposite to side wall portion 24.

Third leg portion 70 generally defines a clip member and includes a first section 85 extending from first leg portion 68 generally intermediate ends 73 and 74, a straight second section 86 which extends substantially parallel to the majority of first leg portion 68, and a third, angled section 88. With this construction, a second retaining slot 89 is defined between first and third leg portions 68 and 70, with slot 89 opening in a direction opposite first retaining slot 80.

Retainer element 39 is also formed with first and second, spaced seal connection structures generally indicated at 91 and 92. In accordance with the most preferred form of the invention, the first seal connection structure 91 is defined by a first connection member 95 which extends from in-turned leg section 78 of second leg portion 69 and which defines a terminal hook or lip 96. Second seal connection structure 92 generally defines an elongated chamber or cavity 102. More specifically, second seal connection structure 92 includes a first section 107, which projects away from first leg portion 68, and a second section 108, which projects from in-turned leg section 78 of second leg portion 69, extends for a portion substantially parallel to first leg portion 68 and finally curves towards first section 107. In any event, an elongated opening (not separately labeled) is defined between first and second sections 107 and 108, with the elongated opening leading into chamber 102.

Figure 2:
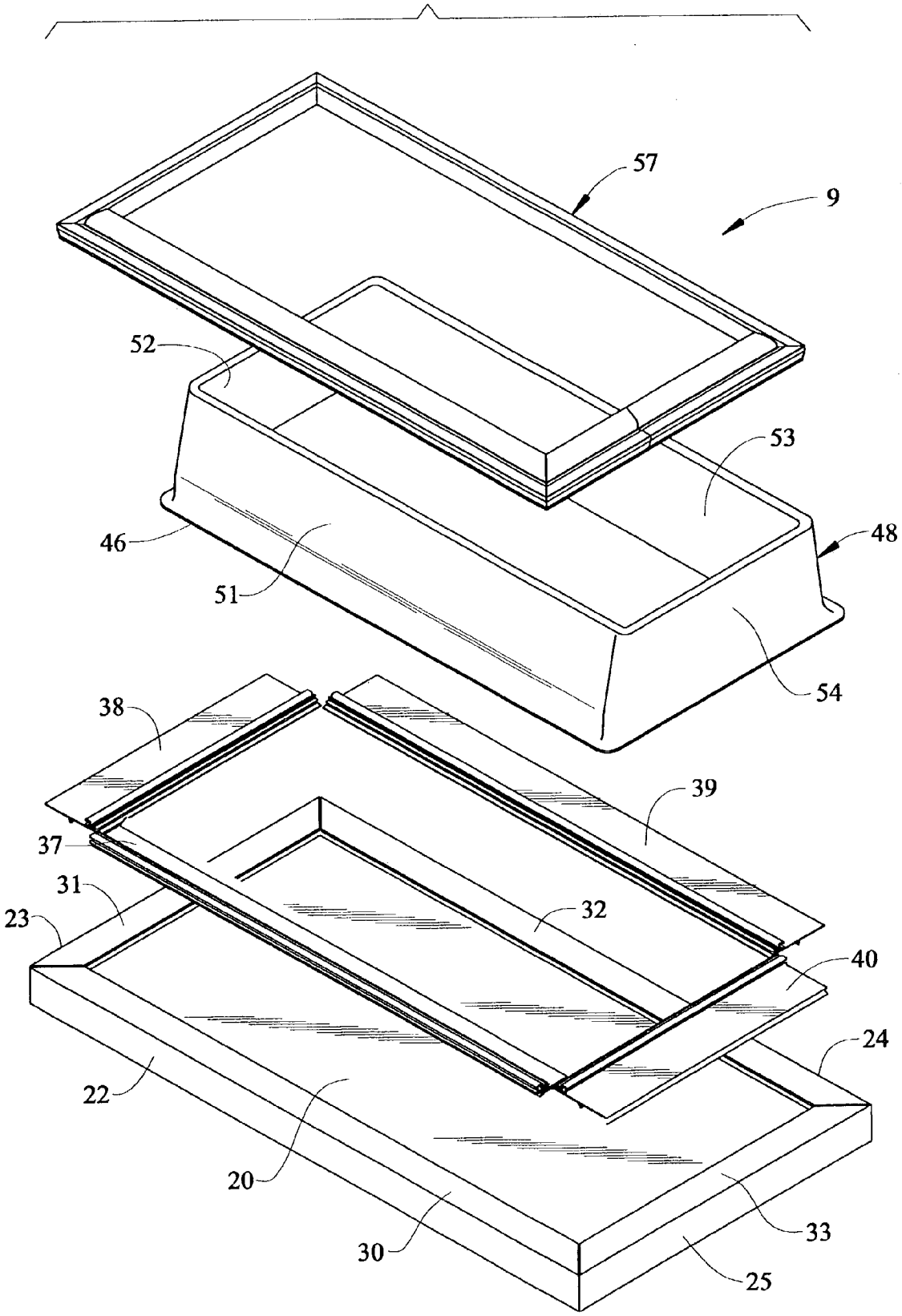
FIG. 2 is an exploded view of the door with the seal and retainer assembly of FIG. 1.

As indicated above, retainer elements 38 and 40 are preferably, identically constructed to retainer element 39 except that retainer elements 38 and 40 are simply shorter in length as clearly illustrated in FIG. 2. However, retainer element 37, which is generally adapted to extend adjacent mullion 16 when fresh food door 9 is closed, has a slightly modified form which will now be described with reference to FIGS. 3 and 5.

As shown, retainer element 37 includes a first leg portion 116, a second leg portion 117, and a third leg portion 118. First leg portion 116 includes an outer end 120 and an inner arcuate end 123 which leads into third leg portion 118. On the other hand, third leg portion 118 terminates in an angled outer end 124 which preferably angles toward door panel 20. As clearly shown, second leg portion 117 is constructed substantially identical to second leg portion 69 such that a retaining slot 129 is defined between first and second leg portions 116 and 117. A first seal connection structure 131 includes a first connection member 132 which projects from second leg portion 117 and, in a manner similar to first connection member 95, terminates in a hook or lip 133. Retainer element 37 also includes second seal connection structure 135 that defines an elongated chamber or cavity 136. Specifically, outer end 120 of first leg portion 116 projects substantially perpendicular to a majority of first leg portion 116 and, in combination with section 138, which generally corresponds to sections 108 described above, defines an elongated opening (not labeled).

Reference will now be made to the drawings in describing the preferred construction of seal assembly 57. As perhaps best shown in the enlarged views of FIGS. 4 and 5, seal assembly 57 is preferably formed of an elastomeric material and includes a primary seal 155 having an internal zone 157 that, although not shown, preferably houses a magnetic strip which is adapted to abut and seal against a respective face 15, 16 upon closing of door 9. Seal assembly 57 also includes a secondary seal generally indicated at 161. Preferably, secondary seal 161 includes a thickened portion 164, as well as a thin, flexible portion 165, which is joined to thickened portion 164 at a tip seal portion 166. As shown in FIG. 5, tip seal portion 166 is preferably angled and, at least initially, would actually take the form shown in FIG. 4 upon installation as will be more fully discussed below.

Primary seal 155 is linked to secondary seal 161 through a first flexible element 168. Seal assembly 57 also includes a narrow or dart-shaped coupling member 176 including a triangular shaped base 180 that is linked to primary seal 155 through a second flexible element 182. Coupling member 176 includes a main arrow body 185 which preferably defines a central hollow zone 187. Base 180 is preferably, directly interconnected to thickened portion 164 of secondary seal 161 through a thickened, seal leg 191. Thickened portion 164 is also formed with a hooking member or lip 196.

During assembly, retainer elements 38-40 are attached to three out of the four side portions of out-turned peripheral flange 46 of liner 48, with respective portions of out-turned peripheral flange 46 being positioned within a corresponding first retaining slot 80. In addition, retainer element 37 is attached to in-turned flange 30, with in-turned flange 30 being received between first and third leg portions 116 and 118. When retainer element 37 is fully mounted, outer angled end 124 preferably abuts side wall portion 22. In attaching door liner 48 to door panel 20, the remaining exposed portion of out-turned flange 46 of door liner 48 is initially inserted in a slot 129 as illustrated in FIG. 5. Thereafter, door liner 48 is pivoted toward door panel 20, whereupon the structure of third leg 70 on each of retainer elements 38–40 is snap-connected to a respective in-turned flange 31–33 of door panel 20. In this manner, each in-turned flange 31–33 is received in a respective slot 89 as shown in FIG. 4.

After outer door panel 20, retainer elements 37–40 and liner 48 are assembled, door 9 is preferably injected with foamed insulation (not shown) which cures to positively interconnect these components together. At this point, fresh food door 9 is ready to receive seal assembly 57. Preferably, this attachment occurs by initially arranging secondary seal 161 against liner 48 until a respective terminal lip 96, 133 is interengaged with a respective portion of hooking member 196. Thereafter, seal assembly 57 is stretched and generally snapped into place with coupling member 176 extending through a respective elongated opening and into a respective chamber 102, 136.

With this overall arrangement, one or more of refrigerator doors 8, 9 can be assembled in a simple, efficient and effective manner which provides a fair amount of latitude in tolerance between the various components. Once assembled, as clearly evident from viewing FIGS. 4 and 5, seal assembly 57 is located more closely adjacent to side wall portion 22 than any of side wall portions 23–25. Upon closing of door 9, primary seal 155 will be attracted to a respective section of either front peripheral face 15 or mullion face 16, while secondary seal 161 will abut and elastically seal against portions of liner 13. In any event, although described with respect to a preferred embodiment of the invention, it should be readily apparent that various changes and/or modifications can be made to the invention without departing from the spirit thereof. Instead, the invention is only intended to be limited by the scope of the following claims.

We claim:

1. A refrigerator door assembly comprising:

an inner liner having an out-turned flange member provided on a peripheral portion;

an outer panel including a side wall portion leading to at least one in-turned flange member;

at least one retainer interconnecting the inner liner to the outer panel, said at least one retainer including first, second and third leg portions, with the second and third leg portions being connected to the first leg portion and extending away from each other at positions spaced from the first leg portion so as to form a first retaining slot between the first and second leg portions and a second retaining slot between the first and third leg portions, with said out-turned flange member of the inner liner extending into the first retaining slot and the at least one in-turned flange of the outer panel being received in the second retaining slot, said at least one retainer being formed with first and second spaced, seal connection structures; and a seal assembly including a first connection element attached to the first seal connection structure of the at least one retainer and a second connection element attached to the second seal connection structure of the at least one retainer.

2. The refrigerator door assembly according to claim 1, wherein the seal assembly includes primary and secondary seals, said primary seal being interconnected to the secondary seal through a first flexible member and to the first connection element through a second flexible member.

3. The refrigerator door assembly according to claim 2, wherein the first connection element comprises a generally arrow-shaped coupling member.

4. The refrigerator door assembly according to claim 3, wherein the second connection element comprises a hooking member.

5. The refrigerator door assembly according to claim 1, wherein the first seal connection structure comprises an elongated chamber having an elongated opening, said first connection element projecting into the chamber.

6. The refrigerator door assembly according to claim 5, wherein the first connection element projects into the chamber in a direction substantially parallel to the in-turned flange member of said outer panel.

7. The refrigerator door assembly according to claim 6, wherein the second seal connection structure extends substantially perpendicular to the in-turned flange member of the outer panel.

8. The refrigerator door assembly according to claim 1, wherein the at least one in-turned flange member includes four in-turned flange portions and said at least one retainer includes four retainer strips attached to the four in-turned flange portions respectively.

9. The refrigerator door assembly according to claim 8, wherein three of the four retainer strips are identical in cross-section, with each said second retaining slot being defined by a clip.

10. A refrigerator door assembly comprising:

an outer panel including a side wall portion leading to at least one in-turned flange portion;

an inner liner including at least one peripheral flange portion;

at least one retainer interconnecting the inner liner to the outer panel, said at least one retainer having a first end portion engaged with the in-turned flange portion of the outer panel and a second end portion engaged with the peripheral flange portion of the liner; and a seal assembly including primary and secondary seals, as well as first and second, spaced connection elements, said first connection element being attached to each of the primary and secondary seals and said second connection element extending directly from the secondary seal, said seal assembly being directly connected to the at least one retainer through the first and second connection elements, with said first connection element being attached to the at least one retainer along an axis substantially parallel to the in-turned flange portion of the outer panel.

11. The refrigerator door assembly according to claim 10, wherein the first connection element comprises a generally arrow-shaped coupling member.

12. The refrigerator door assembly according to claim 11, wherein the second connection element comprises a hooking member.

13. The refrigerator door assembly according to claim 10, wherein the at least one retainer includes an elongated chamber having an elongated opening, said first connection element projecting into the chamber.

14. The refrigerator door assembly according to claim 13, wherein the second connection element is attached to the at least one retainer in a direction substantially perpendicular to the in-turned flange portion of the outer panel.

15. The refrigerator door assembly according to claim 10, wherein the at least one in-turned flange portion includes four in-turned flange portions and said at least one retainer includes four retainer strips extending along the four in-turned flange portions respectively.

16. The refrigerator door assembly according to claim 15, wherein three of the four retainer strips are identical in cross-section and include respective clips for snap-connecting to respective ones of the four in-turned flange portions.

17. The refrigerator door assembly according to claim 10, wherein said at least one retainer includes first, second and third leg portions, and further comprises a first retaining slot, which is defined between the first and second leg portions and receives the at least one peripheral flange portion of the inner liner, and a second retaining slot, which is defined between the first and third leg portions and receives the at least one in-turned flange portion of the outer panel.

18. A refrigerator door assembly comprising:

an outer panel including at least first and second opposing in-turned flange portions;

an inner liner including at least first and second opposing out-turned flange portions;

a first retainer strip attached to the first in-turned flange portion of the outer panel, said first retainer strip including a retaining slot within which the first out-turned flange portion of the inner liner is positioned;

a second retainer strip attached to the second out-turned flange portion of the inner liner, said second retainer strip including a clip member which is snap-connected to the second in-turned flange portion of the outer panel; and a seal assembly attached to each of the first and second retainer strips.

19. The refrigerator door assembly according to claim 18, further comprising: third and fourth retainer strips interconnecting the inner liner to the outer panel.

20. The refrigerator door assembly according to claim 19, wherein the second, third and fourth retainer strips are identically constructed, but different from the first retainer strip.

21. The refrigerator door assembly according to claim 18, wherein the seal assembly includes primary and secondary seals, as well as first and second, spaced connection elements, said first connection element being attached to each of the primary and secondary seals and said second connection element extending directly from the secondary seal, said seal assembly being directly connected to each of the first and second retainer strips through the first and second connection elements, with said first connection element being attached to the first and second retainer strips along an axis substantially parallel to the first and second in-turned flange portions of the outer panel.

22. The refrigerator door assembly according to claim 21, wherein the first connection element comprises a generally arrow-shaped coupling member.

23. The refrigerator door assembly according to claim 22, wherein the second connection element comprises a hooking member.

24. The refrigerator door assembly according to claim 18, wherein each of said first and second retainer strips includes first, second and third leg portions, and further comprises a first retaining slot, which is defined between the first and second leg portions and receives a respective one of the first and second out-turned flange portions of the inner liner, and a second retaining slot, which is defined between the first and third leg portions and receives a respective one of the first and second turned flange portions of the outer panel.

* * * * *